United States Patent [19]

Focke

[11] 4,434,947

[45] Mar. 6, 1984

[54] AXIALLY DISPLACEABLE REEL HOLDER FOR PACKING MACHINE WEBS

[75] Inventor: Heinz H. Focke, Verden, Fed. Rep. of Germany

[73] Assignee: Focke & Co., Verden, Fed. Rep. of Germany

[21] Appl. No.: 403,207

[22] Filed: Jul. 29, 1982

Related U.S. Application Data

[63] Continuation of Ser. No. 184,445, Sep. 5, 1980, Pat. No. 4,366,932.

[30] Foreign Application Priority Data

Sep. 18, 1979 [DE] Fed. Rep. of Germany ..... 2937661

[51] Int. Cl.[3] ..... B65H 19/12; B65H 25/26

[52] U.S. Cl. ..... 242/57.1; 242/68.3

[58] Field of Search ..... 242/58.6, 79, 57.1, 242/68.3, 81; 226/15–20

[56] References Cited

U.S. PATENT DOCUMENTS

| | | | |
|---|---|---|---|
| 2,066,377 | 1/1937 | Wean et al. | 242/58.6 X |
| 2,268,887 | 1/1942 | Matteson | 242/57.1 X |
| 2,561,543 | 7/1951 | Teplitz | 242/79 |
| 3,477,655 | 11/1969 | Anderson | 242/57.1 |
| 3,478,974 | 11/1969 | Roscoe et al. | 242/58 |
| 3,568,904 | 3/1971 | Kurz | 226/15 |
| 3,847,366 | 11/1974 | Schmidt et al. | 242/68.3 |
| 4,054,251 | 10/1977 | Henderson | 226/15 X |

*Primary Examiner*—John M. Jillions

*Attorney, Agent, or Firm*—Sughrue, Mion, Zinn, Macpeak and Seas

[57] ABSTRACT

A reel 12 for a web of packaging material, such as metal foil for wrapping cigarettes, is axially extendable outwardly from the machine base 10 to facilitate web roll replacement. Such extension, and retraction, is implemented by a double acting pneumatic piston and cylinder 30, 31 mounted within the hollow reel axle 16 between a central web 35 of the axle and a surrounding tubular housing 24. Fine transverse adjustments of the web feed are made by a bidirectional worm 50 driving a rotatable wheel nut 51, 52 in response to output signals from a lateral movement sensing unit 38.

6 Claims, 2 Drawing Figures

AXIALLY DISPLACEABLE REEL HOLDER FOR PACKING MACHINE WEBS

Figure 1:
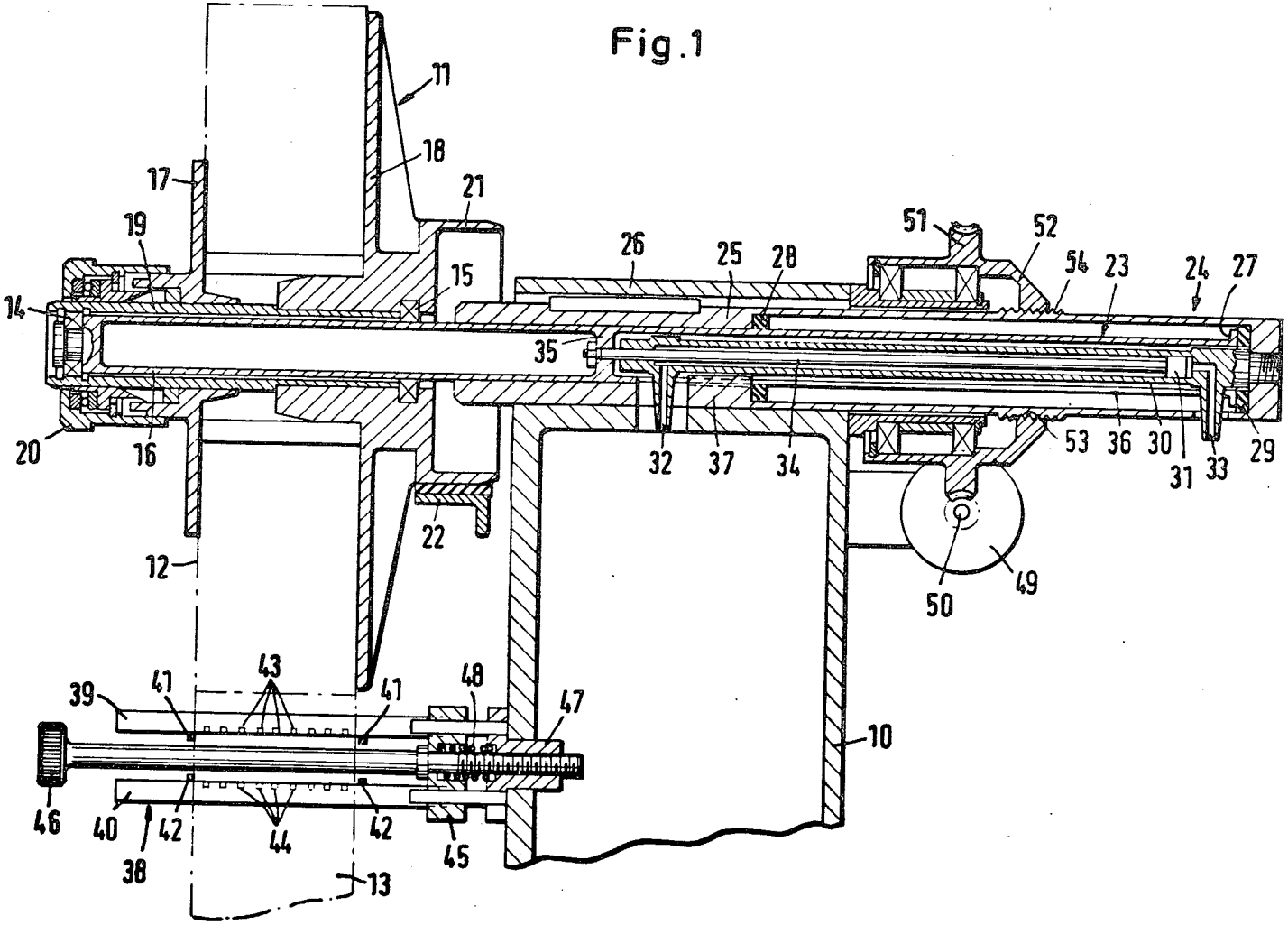

This is a continuation of application Ser. No. 184,445, filed Sept. 5, 1980, now U.S. Pat. No. 4,366,932.

DESCRIPTION

The invention relates to a reel holder for interchangeably receiving at least one rotatable reel support for web-like packing material or the like, particularly in conjunction with a packing machine.

Blanks for the production of packs, particularly cigarette packs, are frequently cut off a continuous web of packing material directly in or on the packing machine. This applies particularly to thin-walled packing material, for example to the inner wrapper made of tinfoil for a cigarette pack.

The web-like packing material is wound into rolls on a reel accommodated on a reel support or drum which is normally arranged above the packing machine approximately in the longitudinal central plane thereof. The web is then drawn off this reel support in accordance with the production of blanks by the packing machine. In the case of high-speed packing machines it is frequently necessary to replace the empty, used reels for full reels, despite the extensive rolls of packing material. The used reel (or a core which, for example, is made of cardboard) is in each case removed from the holder (from the reel support) in the axial direction and replaced by a new reel. For this purpose the reel is fixed on the reel support by a special cap nut which can be easily loosened.

Changing the reels is often difficult for the operating personnel, particularly when the reel holder is arranged at a relatively long distance from the lateral edge of the packing machine which may jut out considerably. The operator then has to bend far over the packing machine.

It is the underlying object of the invention to propose a reel holder, particularly in conjunction with packing machines, which enables reels to be changed easily and rapidly.

To achieve this object the invention is characterised in that the reel or the reel support can be moved between a working position and stand-by position (particularly for changing the reel).

The movability, of the reel holder or of the reel support, which covers a considerable distance can be achieved by axial displacement, or even by a swivelling movement or by any other type of movement.

Within the meaning of the object of the invention the reel holder can, for the purpose of changing the reel, be displaced sideways until it is in an easily accessible position, namely in the lateral area of the packing machine or even to the side of and next to the said machine.

In the preferred exemplary embodiment of the invention the reel support is axially displaceable and, for this purpose, is mounted on an axle which is in turn axially displaceable and thereby causes the sideward movement of the reel. For this purpose the axle is provided with an extension, namely a bearing section, which is mounted (slidably) displaceably in a fixed guide. In accordance with a further proposal a pressure medium-operated cylinder is rigidly mounted in the bearing section which is preferably in the form of a hollow axle, the piston rod of the said cylinder being connected to the axle or to the bearing section thereof to execute the axial displacements.

In accordance with a further proposal of the invention the reel support is adjustable within a range of small amplitude of movement irrespective of the displacement in the above sense. This fine adjustment is effected to adjust the unwinding web of packing material to a precise relative position. The aforementioned fine adjustment is effected by displacing the guide, which is in the form of a housing, for the shaft. The gear provided for this purpose is a spindle drive which acts on a cap nut.

The invention also relates to the arrangement and design of a unit for monitoring the web of packing material with regard to the preceise run-off position and for possible breaking down or initial tearing of the material.

An exemplary embodiment of the invention is explained in more detail below with the aid of the drawings.

Figure 2:
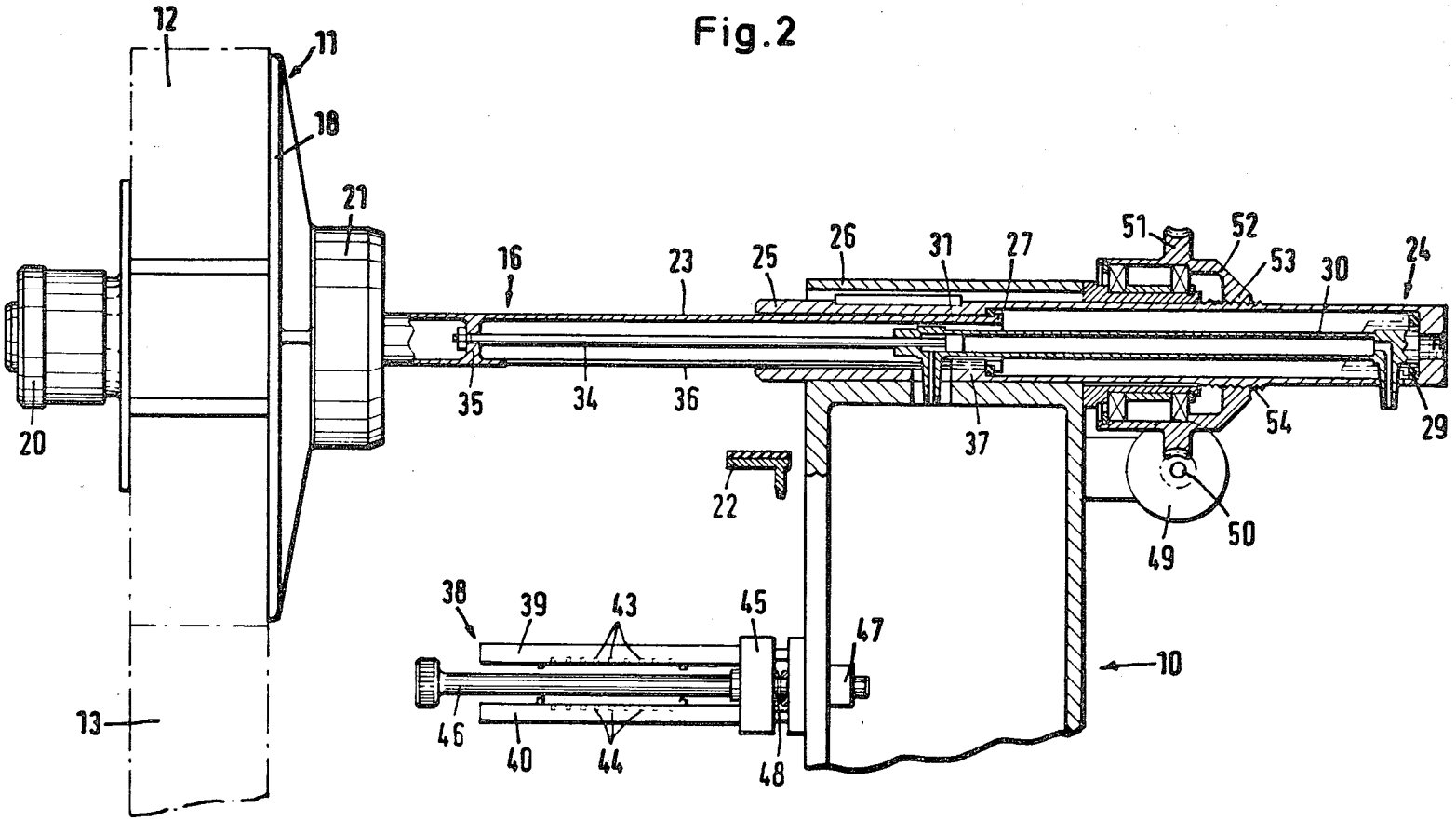

In the drawings:

FIG. 1 shows, in longitudinal section or axial section, the reel holder in the working position, FIG. 2 shows, partially in elevation, partially in axial section, the reel holder according to FIG. 1, with the reel support extended laterally.

The reel holder shown as a detail in the drawings is preferably used in conjunction with a packing machine. In this case the reel holder is normally located above the packing machine in the longitudinal central plane thereof. A base 10 of the machine frame is shown as part of the packing machine or of another unit. The reel holder comprising an eccentric, laterally staggered holder for a reel support 11 is mounted on or against this base.

The reel support 11 is used in the customary manner to receive a reel 12 consisting of a wound-on web 13 of the packing material, for example of tinfoil. With the aid of bearings 14 and 15, the reel support 11 is rotatably mounted on an axle 16 which in this case is in the form of a hollow axle. The reel support 11, which is formed of two side pieces 17 and 18, is held together by a sleeve 19 which encloses and is rotatable with the axle 16.

The smaller side piece 17, which is mounted on the free side, can be drawn off the sleeve 19 in the axial direction, after a specially designed cap nut 20 of special construction is loosened. After the cap nut 20 is loosened and the side piece 17 drawn off, the reel 12 can be changed or a reel 12 can be mounted on the empty reel support 11 after removal of a reel core.

In the present exemplary embodiment the side piece 18, which is rigidly mounted on the sleeve 19 and therefore on the axle 16, is provided with a brake drum 21 which cooperates with a movable brake shoe 22.

To change the reel 12, the reel support 11 can be displaced transversely, that is, in the axial direction in this case. For this purpose the axle 16 is provided, on the side opposite the cap nut 20, with an extension in the form of a bearing section 23. The said bearing section 23, which is in the form of a hollow axle, is in turn slidably located in a housing 24 which is tubular in this case. On the side facing the reel support 11, the housing 24 is provided with a narrowed cross-section, namely a guide section 25, in which the axle 16 or the bearing section 23 is slidably guided and mounted.

The housing 24 is in turn also axially slidable—within a narrow range—and is correspondingly mounted on the base 10 in a holder 26.

The free end of the bearing section 23 is provided with a collar 27 which serves as a stop to limit the movements. Stops 28 and 29 at opposite ends of the housing 24 are provided with elastic bearing surfaces.

An elongated, slender pressure medium-operated cylinder 30, in particular a pneumatic cylinder, is rigidly mounted inside the hollow bearing section 23 of the axle 16, that is to say the cylinder is connected to the bottom of the housing 24. A piston 31, to which compressed air can be admitted in one direction or the other via connections, 32, 33, is displaceable in the pressure medium-operated cylinder 30. The end of a piston rod 34 emerging from the pressure medium-operated cylinder 30 is connected to the bearing section 23 and therefore to the axle 16 in the area of an intermediate wall 35.

When compressed air is admitted to the piston 31 which is in the position shown in FIG. 1, the piston moves inside the pressure medium-operated cylinder 30 until it reaches the final position shown in FIG. 2. The axle 16 is thereby displaced in the longitudinal direction. The bearing section 23 slides in the housing 24 until the collar 27 bears against the stop 28. The reel support 11 is now located at an easily accessible point.

The axle 16 in the present case is non-rotatable. A longitudinal slot 36 is formed in the said axle 16 in the area of the bearing section 23. A projection 37, which is connected to the housing 24, engages in the longitudinal slot 36 and ensures that rotation is prevented. The pressure medium-operated cylinder 30 is also non-rotatably mounted by means of the connections 32 and 33 which extend laterally out of the housing 24.

The reel support 11 can also be subjected to fine adjustments in the axial direction. These adjustments are made to adjust the unwinding web 13 to a precise relative position. This position is in turn monitored by a special sensing unit 38.

The aforementioned sensing unit 38 consists, in the present case, of two sensor rods 39 and 40 spaced apart from one another. Both sensor rods are equipped with a plurality of sensors 41 to 44, that is, one sensor rod is equipped with transmitters, for example light sources, and the other sensor rod with receivers, for example photodiodes.

Each pair of outer sensors 41 and 42 serves to monitor the lateral edges of the web 13 for possible inclinations in the material. A further, larger number of sensors 43 and 44 serves to monitor possible initial tearing and breaking down of the web 13. Since tears may form at a very acute angle to the direction of movement of the web 13, the large number of sensors are spaced at a relatively short distance from one another.

The relative position of the sensing unit 38, which in this case is also fitted on the base 10, is adjustable. For this purpose the sensor rods 39, 40 are mounted on a common support 45 which in turn can be moved against a compression spring 48 via an adjusting screw 46 and an adjusting nut 47.

The control signals of the sensors 41 and 42 which are responsible for sensing the edges, can be transmitted to a servomotor 49 which causes appropriate displacement of the reel support 11, that is, via an axial displacement of the housing 24 in the holder 26.

The servomotor 49, which is a d.c. motor controlled by the sensors 41, 42 via a suitable electronic circuit, drives a spindle 50 which extends at right angles to the housing 24. The said spindle in turn causes a spindle wheel 51 to rotate. A cap nut 52, which is rigidly mounted, that is on the base 10, rotates with the spindle wheel 51. An internal thread 53 of the cap nut 52 meshes with an external thread 54 on the housing 24. Very fine axial adjustments of the reel support 11 can be made by this gear.

The sensors 43 and 44 operate in such a way that the machine or a part thereof is stopped in the event of a tear in the web 13 of the packing material.

What is claimed is:

1. A reel holder mounting arrangement for a packaging apparatus, especially for wrapping groups of cigarettes into cigarette packs, comprising:

(a) a machine base (10), (b) a reel holder (11) for receiving a replaceable web roll of packaging material, (c) an axle (16) embodying means for removably mounting the reel holder at one end thereof, (d) a hollow elongated bearing section (23) coaxial with and extending from the other end of the axle, (e) fluid piston and cylinder means (30, 31) disposed within the bearing section and coupled between the axle and the machine base for implementing coarse axial extensions and retractions of the axle and a web roll carrying reel holder mounted thereon to enable safe web roll replacement, (f) means including tubular outer housing (24) surrounding the bearing section for mounting the bearing section to the machine base, and (g) precision gear drive means mounted directly between the outer housing and the machine base for bidirectionally axially displacing the outer housing to implement the fine-adjusting of the operating position of the reel holder relative to the machine base to ensure proper web feed.

2. An arrangement according to claim 1, wherein said precision gear drive means comprises a rotatably driven spindle (50) engaging a wheel nut (51) rotatably mounted to the machine base, and means (53, 54) threadingly coupling the wheel nut to the outer housing.

3. An arrangement according to claim 2, further comprising a sensing unit (38) including sensors (41, 42) for sensing the edges of the web (13) of packaging material, and a servomotor (49) responsive to said sensing unit for rotating said spindle.

4. An arrangement according to claim 3, wherein the sensing unit (38) comprises at least two sensor rods (39, 40) individually mounted on opposite sides of a web (13) and located in an area of web withdrawal, each of the sensor rods being equipped with at least one pair of sensors for transmitting and receiving edge detection signals.

5. An arrangement according to claim 4, wherein the sensor rods are equipped with a plurality of further sensors (43, 44) located in the area of the web (13) to monitor the web for the formation of tears.

6. An arrangement according to claims 4 or 5, further comprising a mechanism (46, 47, 48) for laterally adjusting the sensing unit relative to the web.

* * * * *